United States Patent [19]

Jivoin

[11] Patent Number: 4,770,080

[45] Date of Patent: Sep. 13, 1988

[54] PANPIPE HAVING TONE SETTING CONTROLS

[76] Inventor: Otto Jivoin, 6834 N. Minnetonka Ave., Chicago, Ill. 60646

[21] Appl. No.: 86,409

[22] Filed: Aug. 17, 1987

[51] Int. Cl.[4] ..... G10D 7/02

[52] U.S. Cl. ..... 84/330; 84/381; 84/386

[58] Field of Search ..... 84/330, 349, 350, 375, 84/380, 381, 384, 386

[56] References Cited

U.S. PATENT DOCUMENTS

| | | | |
|---|---|---|---|
| 500,433 | 6/1893 | Schubert | 84/330 |
| 2,619,865 | 12/1952 | Lynch | 84/330 |
| 4,240,320 | 12/1980 | Pellerite | 84/384 |

FOREIGN PATENT DOCUMENTS

| | | | |
|---|---|---|---|
| 2563 | of 1895 | United Kingdom | 84/384 |

*Primary Examiner*—Lawrence R. Franklin

*Attorney, Agent, or Firm*—Kinzer, Plyer, Dorn, McEachran & Jambor

[57] ABSTRACT

The disclosed panpipe has adjustable plug means for closing and sealing the otherwise open tube bottoms at adjustable distances from the open tube tops, for tuning the panpipe tubes. The plug means includes a plunger seal fitted inside the tube, a manual adjustor rotatably mounted at the bottom of the tube, and threaded means connecting the plunger seal and manual adjustor together. Rotation of the manual adjustor finely shifts the axial position of the plunger seal in the tube. The plunger seal has a flexible sealing ring that can be loosened to slide freely within the tube, and that can be tightened to radially deform sealingly and mechanically against the tube inside. Means accessible via the open tube tops allow each threaded member to be manually rotated from the exterior of its tube, to tighten or loosen the associated sealing ring and set or release the plunger seal as adjusted axially relative to the tube.

16 Claims, 1 Drawing Sheet

PANPIPE HAVING TONE SETTING CONTROLS

BACKGROUND OF THE INVENTION

A column of air, contained within a tube, can be vibrated to produce a sound, by properly directing an air stream cross-wise over an open end of the tube. Where the tube is continuous, without any side openings and with the opposite end closed, the basic inside tube length and diameter determine the primary and secondary resonant vibrations, or tones, generated in the tube. Within limits, the resonant vibrations of the tube may be adjusted, or fine tuned, by varying this inside tube length slightly.

A panpipe, or pan flute, is made up of many separate resonant tubes, of different lengths to generate different tones, secured together side-by-side. The top ends of the tubes are open and generally aligned, and the bottom ends of the tubes are closed. The person playing the instrument holds it with the tubes generally aligned upright, and blows the activating air streams somewhat horizontally cross-wise to the open tube ends.

By selecting and/or adjusting the lengths and/or diameters of the tubes, the panpipe may be set up to play notes of a musical scales. A simple panpipe may have tubes of givèn fixed inside lengths, to produce only the tone preset for each tube; and such a panpipe provides for no adjusting or tuning of these tones.

For more expensive quality panpipes, some tuning may be provided. One basic means of tuning is to fill part of each individual tube interior, above the closed end, with a solid core of wax or like material; and to shave off the upper face portion of the material to the interior column height desired for producing the desired tone. This is done with a boring tool inserted into the tube from the open top end. As variations may exist in the inside tube diameter, merely boring to a specific column height may not produce the correct tone. Consequently, when the actual column height approaches that expected, the tube will be fine tuned by ear by alternately sounding it in resonance, and subsequently by minutely removing material, until the tone produced is true.

This tuning sequence may be quite perplexing since, one cannot simultaneously activate the tube and remove excess material, but these steps must be alternated; and should one remove too much material, additional material must be added to the tube interior and the tuning process repeated again.

This type of tuning also does not readily allow for individual or after market tuning of the tube, by anyone not having the skills and/or equipment needed for such a task.

When considering that a panpipe may have twenty four or more separate tubes, with each expected to produce a different properly tuned tone, this tuning sequence proves to be very time consuming and expensive.

Another means for varying the tone of an individual panpipe tube is with a closure plug inserted into an otherwise open bottom end of the tube. In one form, the plug may be sized to be inserted to some particular debth; while in another form, the tube may have some built-in stop to position the plug at one specific location. However, fine tuning to precise and/or different tones with such means is difficult, as controlled minute shifting of the plug is difficult.

A means for fine tuning an individual panpipe tube includes inserting a closure plug into the otherwise open bottom end of the tube, and adjusting the axial position of the plug minutely with a threaded screw connected to the plug. Several drawbacks exist within known versions of this, including: (1) when the plug can be axially adjusted within the tube, it may not be sufficiently tight to seal the tube; while (2) it may not be possible to tighten the adjusted plug for effectively sealing and locking it in the adjusted position, without at least partically disassemblying the overall panpipe structure.

SUMMARY OF THE INVENTION

The present invention provides a panpipe musical instrument having many substantially parallel resonant tubes, with end closure means that may be adjustably set to a precise location within each tube, and locked firmly as adjusted, by exterior adjustment means, without any disassembly of the panpipe and while the tube may simultaneously be sounded in resonsance, for rapid and accurate fine tuning of the panpipe, even over different musical scales.

BRIEF DESCRIPTION OF THE DRAWINGS

Further advantages and features of the present invention will appear from the following disclosure and description, including as a part thereof the accompanying drawings, in which.

DETAILED DESCRIPTION OF AN ILLUSTRATED EMBODIMENT

Figure 1:
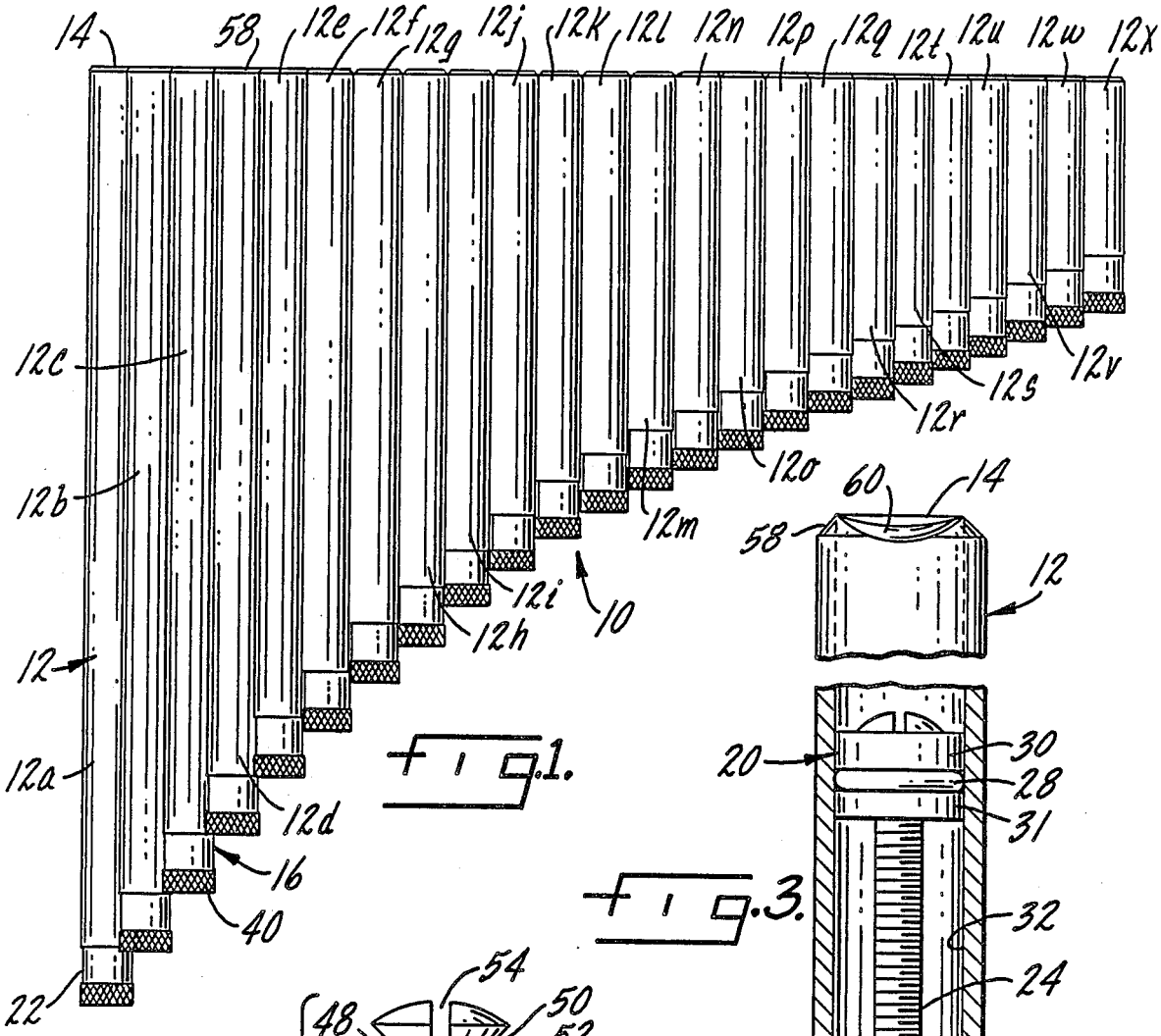
FIG. 1 is a front elevational view of the panpipe formed according to this invention.

The panpipe 10 illustrated has many separate tubes 12 secured together in substantially parallel side-by-side relation, to define a unitary structure. The tubes may be referred to in this disclosure collectively as 12, or individual as 12*a*, 12*b*, etc., depending on the need for individual identity. Each tube 12 is substantially cylindrical in shape, having a normally open top 14 and having a normally open bottom 15 that is closed by plug means 16 defining this invention.

The open tube tops 14 are generally aligned along a common plane disposed perpendicular to the longitudinal axes of the tubes. The tube bottom 15 are misaligned in the direction perpendicular to the longitudinal axes of the tubes, varying in a stepped fashion between the longest tube 12*a* and the shortest tube 12*z* at the opposite side edges of the panpipe 10.

Each tube 12 thus defines within it a column of air, above the closed bottom plug 16 and the open top 14. The longest tube 12*a* of the panpipe defines the longest air column, that when activated produces the slowest rate of resonant vibrations and the lowest pitch tone; while the shortest tube 12*z* defines the shortest air column, that when activated produces the fastest rate of resonant vibrations and the highest pitch tone. The tubes 12*b*–12*y* between these end tubes, define intermediate pitch tones, preferably progressing note-by-note throughout the selected scale.

The illustrated panpipe 10 has twenty four adjacent tubes 12, to produce the basic tones of the standard eight-note scale, over three octaves. This may be between D below middle C, and F above high C. The tube diameters, in inches, may be: 11/16 OD and 9/16 ID for the longer tubes 12*a* through 12*g*; ⅝ OD and ½ ID for the intermediate length tubes 12*h* through 12*r*; and 9/16 OD and 7/16 ID for the shorter tubes 12*s* through 12*x*; while the tunable inside tube lengths may be between approximately 11.5 and 2.3 inches, for tubes 12*a* and 12*z* respectively.

Figure 3:
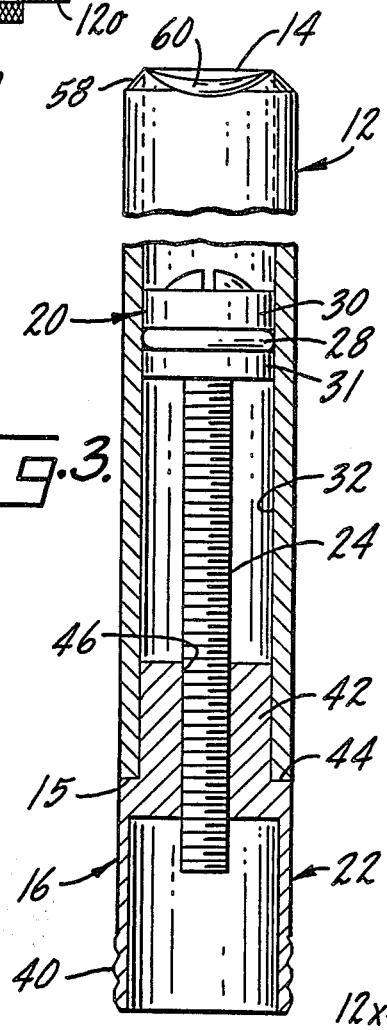
FIG. 3 is an enlarged fragmentary sectional view of the tube, taken generally along line 3—3 in FIG. 1, particularly illustrating the open top tube end, and the closed bottom to end and the adjustable closure for forming the same.
Figure 4:
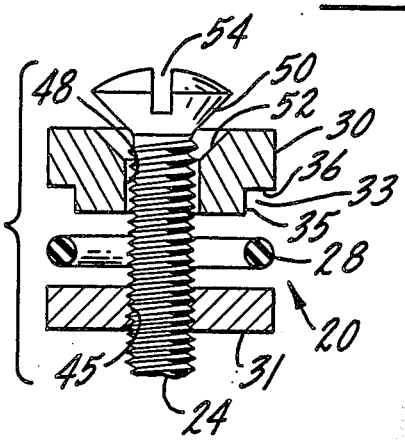
FIG. 4 is an exploded view of the components forming the adjustable end closure of FIG. 3.
Figure 2:
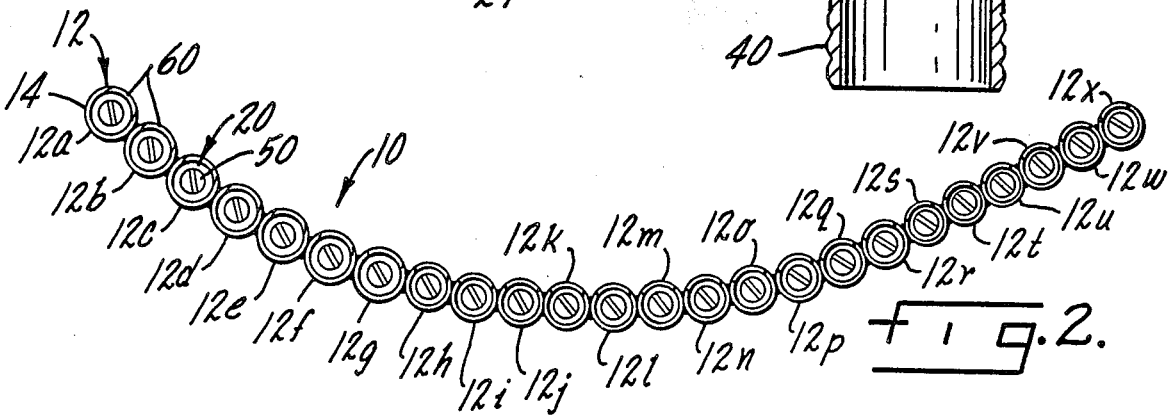
FIG. 2 is a top plan view of the panpipe of FIG. 1.

The plug means 16 illustrated in FIG. 3 includes a plunger seal 20, a manual adjustor 22, and a threaded member 24 connecting the plunger seal and actuator components 20 and 22 together.

The plunger seal 20 has a deformable sealing ring 28, and separate rigid disc members 30 and 31. The sealing ring 28 may be of rubber, in the form of an O-ring; while the disc members 30 and 31 may be of metal or plastic. The disc members 30 and 31 are smaller than the inside surface 32 of said tube 12, to fit freely therewithin. The disc member 30 has a peripheral cutout 33, defined by axial face 35 and radial face 36, for receiving the sealing ring 28. The sealing ring 28 is just about the same size as the outside axial surface 35 and the inside tube surface 32, to fit between them while yet being slidable within the tube 12. The sealing ring 28 is thicker than the length of axial surface 35, to be trapped between and deformed by the radial surface 36 of the disc member 30 and the disc member 31, as the disc members close against one another.

The manual adjustor 22 is basically cylindrical in shape, having a hollow knurled gripping portion 40 exposed beyond the open end 15 of the tube and a smooth adjacent necked down seating portion 42. The seating portion 42 fits into the open tube bottom, until the tube end 15 engages the radial shoulder 44 between the stepped portions 40 and 42. This cooperation between the adjustor 22 and the tube 12 supports the adjustor rotationally relative to the tube, while prevents axial movement of said adjustor into the tube.

The threaded member 24 connecting the plunger seal 20 and adjustor 22 together is adapted to cooperate with threaded bores 45 and 46 respectively in the disc member 31 and in the adjustor 22, and to extend freely through a larger opening 48 in the disc member 30. A tapered head 50 on the threaded member 24 is received within a complementary countersunk top face 52 on the disc member 30. This defines a reasonably flat top plunger seal surface overall, which is the effective bottom of the air column defined in the tube. The head 50 has a slot 54 therein, suited to receive and become non-rotatably keyed to a standard screw driver (not shown) inserted into the tube 12 from the open top 14 thereof.

The knurled gripping portion 40 has a slightly smaller OD than the OD of its receiving tube 12, to allow the adjustor 22 to be rotated within its tube 12, without binding against the adjacent larger substantially parallel tube. Moreover, the hollow portion of the adjustor 22 extends some axial distance below the threaded bore 46, to surround and effectively hide any portion of the threaded member 24 that may project below the bore.

Each tube 14 may have its upper side edges 58 bevelled at a slight angle from the perpendicular to the longitudinal axis of the tube, such as at possibly 40 degrees. Each tube top 14 also may have a single curved groove 60 formed therein, extended diametrically from the longitudinal axis of the tube and angled just slightly from the perpendicular to the longitudinal axis of the tube, such as at possibly 20 degrees. The groove 60 is located only on the side of the tube remote from the person's mouth blowing into the tube 12. The radius of curvature of the groove may be ¾ inch. This defines a suitable embouchure opening at the open tube top 14.

In the illustrated panpipe 10, the adjacent orientation of the substantially parallel tubes 12*a* through 12*r* may be along a slight uniform curve, such as about a development having a radius of curvature between approximately 7 and 10 inches; while the smaller substantially parallel tubes 12*s* through 12*x* may be along a straight plane extended tangentially from this curved development of the longer tubes. This configuration allows for easy and accurate registry of the activating air stream cross-wise to each of the tubes, without falsely overlapping on any of the adjacent tubes . . . particularly at the upper end of the panpipe where the tubes are of a smaller diameter.

SUMMARY OF THE OPERATION OF THE INVENTION

The disclosed closure means 16 allows the effective tube length, above the bottom closure seal 20 to the open tube top 14, to be adjusted and set to provide a desired resonant tone, by movement of the exterior adjustor 22, and simultaneously while blowing an air stream cross-wise to the respective open tube top or embouchure opening 14, to activate the tube's air column into resonance. The closure means allows tuning of each tube from its basic tone to at least the sharp or flat tones adjacent that tone, as well as to tones of a different scale.

In order to tune any tube 12 of the panpipe 10, the plunger seal 20 is first loosened somewhat to allow it to fit into the open bottom tube end 15, and to slide within the tube. The plunger seal 20 may be loosened by turning the disc member 31 on the screw member 24 to increase the gap between the disc members 30 and 31, but not beyond where they both still contact the sealing ring 28 and compress it slightly. The threaded member 24 is also then threaded relative to the bore 46 in the adjustor 22, to shift the plunger seal 20 to its furthest connected distance from the adjustor 22. The plunger seal 20 is then inserted into the open bottom of the tube, as far as it will go, with the adjustor seating portion 42 also being inserted into the tube until the adjustor shoulder 44 seats against the tube end.

A screw driver, optionally at this time, may be inserted into the open top 14 of the tube 12, keyed to the threaded member slot 54, and turned, to tighten the disc members 30 and 31 against the sealing ring 28 slightly. This deforms the sealing ring 28 radially, inwardly and outwardly, into tighter sealing contact with the disc members 30 and 31, and with the inside tube surface 32. However, any tightening at this time should only be to an intermediate level, as the plunger seal 20 must still be allowed to be axially shifted.

The panpipe tube may now be activated by blowing the air stream over the open tube top 14, and depending on the need, the adjustor 22 may simultaneously be turned by gripping the knurled end 40, to draw the plunger seal 20 toward the adjustor. This tuning may continue until the proper tone desired is sounded, whereupon the proper location of the plunger seal 20 in the tube would have been determined.

The threaded member 24 may have approximately twenty five threads per inch, allowing very fine plunger seal 20 adjustment incrementally within the tube, to achieve tonal adjustments as accurate as the ear or tone comparators will allow. The continuous adjustment over some range of resonant frequencies also allows the entire panpipe to be tuned to a different key or scale.

When the tube has been properly tuned, the plunger seal 20 may now be locked firmly in this axial position within the tube, by positioning (or repositioning) the screw driver into the open top 14 of the tube 12, keying it to the slot 54, and turning the threaded member 24 maybe one-quarter of a turn or until the plunger sealing ring 28 is compressed firmly and mechanically against the tube inside 32, to preclude any further axial movement of the plunger seal 20.

Each of the substantially parallel tubes of the panpipe may be tuned according to this same sequence. When adjusted, the bottom ends of the panpipe tubes would all have a similar appearance, that of the cylindrical adjustor 22; and the threaded member 24 would be hidden within the adjustor.

While only a single embodiment of the invenion has been illustrated, it is apparent that variations may be made therefrom without departing from the inventive concept. Accordingly, the invention is to be limited only by the scope of the following claims.

What is claimed as my invention is:

1. A panpipe having a plurality of separate tubes secured together side-by-side with generally aligned open tops, the improvement being the combination of each of said tubes having an open bottom and plug means fitted inside the tube to close said tube bottom at adjustable distances from the open tube top, for tuning said tube;

said plug means having a plunger seal including a flexible sealing ring and separate rigid disc members sandwiching said sealing ring, and a threaded member connecting the disc members together operable to tighten or loosen them relative to sandwiching the sealing ring;

the sealing ring being sized to fit within and be shifted axially of the tube, when the disc members are loosened relative to the sealing ring;

said plug means also having a manual adjustor seated against the tube bottom to rotate relative to the tube, while being fixed axially relative to the tube and means coupling the plunger to the manual actuator effective to shift the plunger seal axially upon rotation of the manual actuator;

said manual adjustor having a gripping portion exposed beyond the tube bottom, whereby said plunger seal may be axially adjusted within the tube, while said disc members are loosened relative to the sealing ring, upon rotation of the manual adjustor relative to the tube;

the sealing ring being radially deformed by the sandwiching disc members, when the disc members are tightened relative to the sealing ring to seal tightly and mechanically against said tube inside;

means accessible via the open tube top to allow the threaded member to be manually rotated from the exterior of the tube without removing the manual actuator, to tighten or loosen the disc members relative to the sealing member and set or release the plunger seal as adjusted axially relative to the tube; and said accessible means including the end of the threaded member being exposed below and via the open top of the tube, and keying means formed on said exposed threaded member end, whereby a conventional keying tool may be inserted into the open tube top in order to cooperate with the threaded member keying means for manually rotating the threaded member from the exterior of the tube.

2. A panpipe according to claim 1, further wherein said sealing ring is in the form of an O-ring, and wherein one of the disc members has a peripherial cutout open to the other of the disc members, said cutout effectively being smaller in cross-section than the O-ring, operable to receive only part of the O-ring and provide that the O-ring is deformed radially when the disc members are tightened relative to the sealing ring.

3. A panpipe according to claim 1, further wherein the threaded member is extended through openings in the disc members, the opening of the disc member closer to said manual adjustor threadably cooperating with said threaded member and the opening of the disc member remote from said manual adjustor being disengaged from said threaded member.

4. A panpipe according to claim 1, further wherein the separate panpipe tubes are substantially parallel to one another, each tube being adapted to produce a separate tone and such tones being of low to high pitch throughout a scale; wherein the panpipe tubes at certain lower pitch tubes are aligned along a curved development over a slight curvature, and where the panpipe tubes at certain higher pitch tubes are aligned along a straight plane, tangentially of the curved development for the lower pitch tubes.

5. A panpipe according to claim 1, further wherein said accessible means includes a tapered head on the end of the threaded member, and a cooperating countersunk contour on the opening in the disc member remote from said manual adjustor to receive said head, whereby said head and said remote disc member provide a reasonably flat surface facing away from the manual adjustor, and said flat surface defining the bottom of the tube.

6. A panpipe according to claim 5, further wherein said keying means of the accessible means includes a slot formed in the head of the threaded member, and wherein the tool is in the form of a screw driver, that may be inserted into the open tube top to manually rotate the threaded member from the exterior of the tube.

7. A panpipe according to claim 6, further wherein the manual adjustor is cylindrical, and wherein said manual adjustor has a smaller OD than the OD of its receiving tube.

8. A panpipe according to claim 6, further wherein the threaded member is extended through openings in the disc members, the opening of the disc member closer to said manual adjustor threadably cooperating with said threaded member, while the opening of the disc member remote from said manual adjustor is disengaged from said threaded member.

9. A panpipe according to claim 6, further wherein said sealing ring is in the form of an O-ring, and wherein one of the disc members has a peripherial cutout open to the other of the disc members and effectively smaller in cross-section than the O-ring, operable to receive only part of the O-ring and provide that the O-ring is deformed radially when the disc members are tightened relative to the sealing ring.

10. A panpipe according to claim 6, further wherein the panpipe resonant tubes are substantially parallel to one another, each tube being adapted to produce a separate tone and such tones being of low to high pitch throughout a scale; wherein the panpipe tubes at the lower pitch tubes are aligned along a curved development over a slight curvature, and where the panpipe tubes at the higher pitch tubes are aligned along a straight plane, tangentially of the curved development for the lower pitch tubes.

11. A panpipe according to claim 6, further wherein the coupling means is in the form of the threaded member threadably cooperating with the manual adjustor, and wherein the manual adjustor extends annularly of the threaded member and axially thereof beyond its threadable cooperation with the threaded member, sufficient to surround and hide therewithin the projected end of the threaded member, and further wherein the manual adjustor is cylindrical and has a smaller OD than the OD of its receiving tube.

12. A panpipe having a plurality of separate tubes secured together side-by-side with generally aligned open tops, the improvement being the combination of each of said tubes having an open bottom and plug means fitted inside the tube to close said tube bottom at adjustable distances from the open tube top, for tuning said tube;

said plug means having a plunger seal including a flexible sealing ring and separate rigid disc members sandwiching said sealing ring, and a threaded member connecting the disc members together operable to tighten or loosen them relative to sandwiching the sealing ring;

the sealing ring being in the form of an O-ring sized to fit within and be shifted axially of the tube, when the disc members are loosened relative to the sealing ring;

one of the disc members having a peripheral cutout open to the other of the disc members and the other disc members being substantially flat and suited to butt against the one disc member except at the peripheral cutout;

said cutout effectively being smaller in cross-section than the O-ring, operable to receive only part of the O-ring and provide that the O-ring is deformed radially to seal tightly and mechanically against said tube inside, when the disc members are tightened relative to the sealing ring;

said plug means also having a manual adjustor seated against the tube bottom to rotate relative to the tube, while being fixed axially relative to the tube;

means coupling said manual adjustor and plunger seal together, whereby said plunger seal may be axially adjusted within the tube, while said disc members are loosened relative to the sealing ring, upon rotation of the manual adjustor relative to the tube; and means to allow the threaded member to be manually rotated to tighten or loosen the disc members relative to the sealing ring, and set or release the plunger seal as adjusted axially relative to the tube.

13. A panpipe according to claim 12, further wherein the threaded member is extended through openings in the disc members, the opening of one disc member threadably cooperating with said threaded member and the opening of the other disc member being disengaged from said threaded member.

14. A panpipe according to claim 12, further wherein the threaded member is extended through openings in the disc members, the opening of the disc member closer to said manual adjustor threadably cooperating with said threaded member and the opening of the disc member remote from said manual adjustor being disengaged from said threaded member; and wherein the coupling means is in the form of the threaded member threadably cooperating with the manual adjustor.

15. A panpipe according to claim 14, further wherein the means to allow the threaded member to be manually rotated to tighten or loosen the disc members relative to the sealing ring, includes having the end of the threaded member exposed via the open tube top and having screw driver keying means formed thereon, to allow a conventional screw driver to be inserted into the open tube top to become rotatably keyed to the threaded member, in order to manually rotate the threaded member from the exterior of the tube without removing the manual actuator.

16. A panpipe having a plurality of separate tubes secured together side-by-side with generally aligned open tops, the improvement being the combination of each of said tubes having an open bottom and plug means fitted inside the tube to close said tube bottom at specific distances from the open tube top, for tuning said tube;

the separate panpipe tubes being substantially parallel to one another, each tube being adapted to produce a separate tone and such tones being of low to high pitch throughout a scale;

the panpipe tubes at certain lower pitch tubes being aligned along a curved development over a slight curvature; and the panpipe tubes at certain higher pitch tubes being aligned along a straight plane, tangentially of the curved development for the lower pitch tubes.

* * * * *